US007728708B2

(12) United States Patent
Fushimi et al.

(10) Patent No.: US 7,728,708 B2
(45) Date of Patent: Jun. 1, 2010

(54) TRANSFORMER APPARATUS, INVERTER TRANSFORMER, AND DRIVE CIRCUIT

(75) Inventors: Tadayuki Fushimi, Chuo-ku (JP); Hiroyuki Miyazaki, Chuo-ku (JP); Hiroki Miura, Chuo-ku (JP)

(73) Assignee: Sumida Corporation, Tokyo (JP)

( * ) Notice: Subject to any disclaimer, the term of this patent is extended or adjusted under 35 U.S.C. 154(b) by 394 days.

(21) Appl. No.: 11/696,748

(22) Filed: Apr. 5, 2007

(65) Prior Publication Data

US 2007/0247270 A1 Oct. 25, 2007

(30) Foreign Application Priority Data

Apr. 19, 2006 (JP) ..... 2006-116159
Jan. 29, 2007 (JP) ..... 2007-018469

(51) Int. Cl.
*H01F 27/24* (2006.01)
*H01F 27/28* (2006.01)
*H05B 41/16* (2006.01)

(52) U.S. Cl. ..... 336/212; 336/170; 336/214; 336/215; 315/255; 315/257; 315/278

(58) Field of Classification Search ..... 336/170, 336/212, 214, 215; 315/255, 257, 278
See application file for complete search history.

(56) References Cited

U.S. PATENT DOCUMENTS 4,307,334 A * 12/1981 Peil et al. ..... 323/351
4,902,942 A 2/1990 El-Hamamsy
6,310,444 B1 10/2001 Chang
7,279,851 B2 * 10/2007 Ball ..... 315/282
2004/0130426 A1 * 7/2004 Suzuki ..... 336/212
2004/0189432 A1 9/2004 Yan et al.
2007/0139152 A1 * 6/2007 Chan et al. ..... 336/208

FOREIGN PATENT DOCUMENTS

| | | |
|---|---|---|
| JP | 64-030463 | 2/1989 |
| JP | 2000-133531 | 5/2000 |
| JP | 2003-031383 | 1/2003 |
| JP | 2004-506294 | 2/2004 |
| JP | 2004-349293 | 12/2004 |
| JP | 2005-311227 | 11/2005 |
| WO | 02/13581 | 2/2002 |

* cited by examiner

*Primary Examiner*—Lincoln Donovan
*Assistant Examiner*—Ronald W Hinson
(74) *Attorney, Agent, or Firm*—Coats & Bennett, P.L.L.C.

(57) ABSTRACT

The present invention provides a transformer apparatus configured by integrating an inverter transformer and balance transformer to be a downsized form, and a drive circuit using the transformer apparatus. The transformer apparatus comprises an inverter transformer having a core potion on which a primary coil and a secondary coil are wound, and a balance transformer having a core portion on which a primary coil and a secondary coil are wound, wherein the inverter transformer and the balance transformer are integrally formed by sharing a part of the core portions.

7 Claims, 8 Drawing Sheets

FIG. 8

| LP-L, LP-H, LP-R | Lp | Ls | Ls' | COUPLING COEFFICIENT |
|---|---|---|---|---|
| 21T, 17T, 21T | 229μH | 254mH | 100mH | 0.78 |
| 20T, 17T, 20T | 217μH | 254mH | 104mH | 0.77 |
| 19T, 17T, 19T | 204μH | 254mH | 109mH | 0.76 |
| 18T, 17T, 18T | 191μH | 254mH | 102mH | 0.77 |
| 17T, 17T, 17T | 179μH | 254mH | 107mH | 0.76 |
| 16T, 17T, 16T | 168μH | 254mH | 113mH | 0.75 |
| 15T, 17T, 15T | 157μH | 254mH | 119mH | 0.73 |
| 14T, 17T, 14T | 147μH | 254mH | 125mH | 0.71 |
| 13T, 17T, 13T | 139μH | 254mH | 115mH | 0.74 |
| 12T, 17T, 12T | 131μH | 254mH | 122mH | 0.72 |
| 11T, 17T, 11T | 123μH | 254mH | 130mH | 0.70 |
| 10T, 17T, 10T | 116μH | 254mH | 138mH | 0.68 |
| 9T, 17T, 9T | 109μH | 254mH | 145mH | 0.66 |
| 8T, 17T, 8T | 104μH | 254mH | 154mH | 0.63 |
| 7T, 17T, 7T | 99μH | 254mH | 162mH | 0.60 |

TRANSFORMER APPARATUS, INVERTER TRANSFORMER, AND DRIVE CIRCUIT

BACKGROUND OF THE INVENTION

1. Field of the Invention

The present invention relates to transformer apparatuses configured with integrated inverter transformers and balance transformers, inverter transformers including coils for balance transformers, and drive circuits for driving them.

2. Description of the Related Art

It is a widely utilized technology to control currents flowing through a plurality of cold cathode discharge tubes to predetermined values in a cold cathode discharge tube drive circuit by connecting a balance transformer to a low voltage side of the drive circuit or by connecting a balance transformer to a high voltage side to which a cold cathode discharge tube is connected. It is known that in a cold cathode discharge tube, a voltage applied to electrodes of the cold cathode discharge tube fluctuates depending on an impedance fluctuation or the like, so that currents flowing through each cold cathode discharge tube is changed depending on the impedance of each cold cathode discharge tube.

As well-known, on backside of a liquid display panel, a plurality of cold cathode discharge tubes are installed as back-lights. As a recent trend, a size of a liquid display panel becomes larger. For example, an average size for a home-use liquid crystal TV has been changed to use a liquid crystal display panel of 32 to 45 inches from 20 inches.

As the size of the liquid crystal display panel becomes larger, the number of cold cathode discharge tubes used in one liquid crystal TV also increases. Therefore, if the currents flowing through each of the cold cathode discharge tubes are different to each other as described above, unevenness of emission occurs between cold cathode discharge tubes. This invites unevenness of luminance in a liquid crystal display panel, so that it is necessary to comfort currents flowing through installed all cold cathode discharge tubes for providing a high-quality liquid crystal TV. Therefore, it is common to use an inverter transformer and a balance transformer in a cold cathode discharge tube drive circuit.

In this case, conventionally, it has been proposed to connect a balance transformer coil to a low-voltage side or a high-voltage side in a cold cathode discharge tube drive circuit.

Further, an inverter transformer having a plurality of coils has been proposed so as to drive a plurality of cold cathode discharge tubes with a single magnetic path of the inverter transformer.

Sill further, such drive circuit has been proposed that an inductance element connected in series with a first primary coil and an inductance element connected in series with a second primary coil are provided in the same magnetic path.

Also, an inverter transformer configured with an IHI-shaped core portion has been proposed by the assignee of this application. Followings are patent documents related to the drive circuits and/or transformer apparatuses.

Japanese Patent Laid-open No. 2003-31383
Japanese Patent Laid-open No. 2004-506294
Japanese Patent Laid-open No. 2005-311227
Japanese Patent Laid-open No. 2004-349293
Japanese Patent Laid-open No. 64-030463
Japanese Patent Laid-open No. 2000-133531

However, it is well-known that an inverter transformer and a balance transformer are separately produced as independent transformer. Accordingly, in case of assembling a cold cathode discharge tube drive circuit, an inverter transformer, a balance transformer, a switching circuit and a control circuit are generally mounted on a circuit board, independently. However, a separate mounting of an inverter transformer and a balance transformer on the circuit board requires an extra space, and further costs for parts and production also increase. In addition, it is hard to downsize the cold cathode discharge tube drive circuit, and it has become difficult to satisfy the request of downsizing and low-weighting from the liquid crystal display panel side.

SUMMARY OF THE INVENTION

Accordingly, it is an object of the present invention to provide a transformer apparatus which is configured by integrating coils for inverter transformer and coils for balance transformer in order to satisfy downsizing and low-weighting.

It is another object of the present invention to provide an inverter transformer wherein coils for balance transformer are mounted on the inverter transformer.

It is still another object of the present invention to provide a drive circuit for driving the transformer apparatus and/or the inverter transformer.

In order to attain the above object, the transformer apparatus according to an embodiment of the present invention is a transformer apparatus which comprises:

an inverter transformer having a primary coil and a secondary coil; and a balance transformer having a primary coil and a secondary coil, wherein the inverter transformer and balance transformer are integrally formed by sharing a part of a core portion of the transformer apparatus.

In order to attain the above object, the inverter transformer according to another embodiment of the present invention is an inverter transformer for driving discharge tubes which comprises:

a primary coil and a secondary coil, wherein coils configuring a balance transformer having a primary coil and a secondary coil are installed.

In order to attain the above object, the inverter transformer according to further embodiment of the present invention is an inverter transformer for driving discharge tubes which comprises:

a primary coil;

a secondary coil; and a coil for configuring a balance transformer, wherein the primary coil and the secondary coil are wound so that magnetic fluxes generated by both the primary coil and the secondary coil are configured to couple to each other, and a flux path for a magnetic flux generated by the coil for configuring the balance transformer is different from a flux path for the magnetic fluxes generated by the both the primary coil and the secondary coil.

In order to attain the above object, the drive circuit according to still further embodiment of the present invention is a drive circuit for driving at least two transformer apparatus each comprising an inverter transformer having a primary coil and a secondary coil, and a balance transformer having a primary coil and a secondary coil, wherein the inverter transformer and the balance transformer are integrally formed by sharing a part of core portion of the transformer apparatus, the drive circuit comprises:

a switching circuit, and a control circuit for controlling the switching circuit, wherein in each of the transformer apparatus, the primary coil of the inverter transformer and the secondary coil of the balance transformer are connected in series, and an output of the switching circuit is supplied to both ends of the series connection.

According to the present invention, it is possible to provide a transformer apparatus, an inverter transformer, and a drive circuit using the same, wherein an inverter transformer and a balance transformer of the transformer apparatus are integrally formed and thereby transformer apparatus can be downsized. Further features of the present invention will become apparent from the following description of exemplary embodiments with reference to the attached drawings.

Further features of the present invention will become apparent from the following description of exemplary embodiments (with reference to the attached drawings).

BRIEF DESCRIPTION OF THE DRAWINGS

FIG. 8 is a table for describing an operation of the showing the further another embodiment of the present invention.

DESCRIPTION OF THE EMBODIMENTS

First Embodiment

Figure 1:
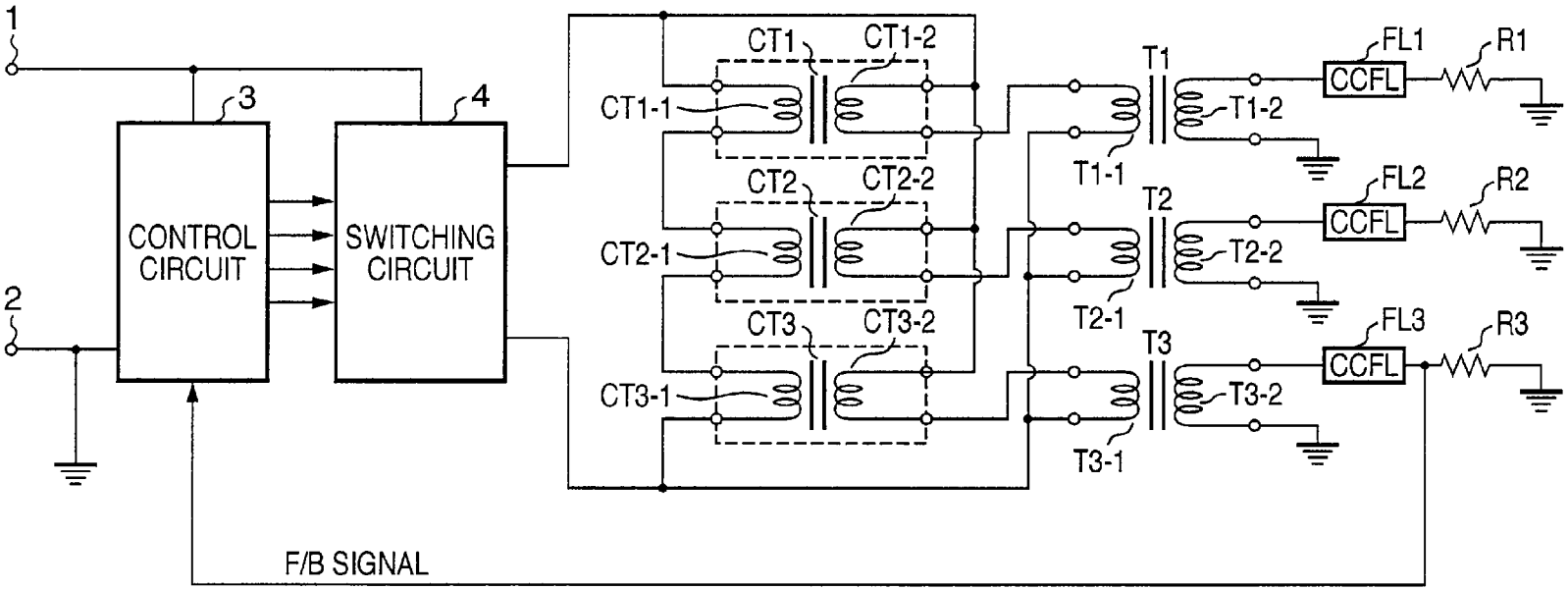
FIG. 1 is a circuit diagram of a cold cathode discharge tube drive circuit according to first embodiment of the present invention to which a transformer apparatus or an inverter transformer according to embodiments of the present invention.

FIG. 1 shows a drive circuit for evenly driving a plurality of cold cathode discharge tubes while using inverter transformers and balance transformers, and is an example of a cold cathode discharge tube drive circuit to which a transformer apparatus or an inverter transformer of the present invention is employed. Now, a cold cathode discharge tube drive circuit in FIG. 1 is described as a first embodiment of the present invention.

A DC voltage is supplied between power supply terminals 1 and 2 in FIG. 1, the DC voltage at the power supply terminal 1 is supplied to a control circuit 3 and a switching circuit 4, and the power supply terminal 2 is connected to ground. The control circuit 3 includes an oscillation circuit and a PWM (pulse width modulation) circuit inside, and pulse-width modulate a switching signal generated in accordance with an F/B signal which is described later. The switching circuit 4 comprises switching circuits configured with transistors, and outputs a pulse drive signal (drive voltage) generated by switching the DC voltage applied between the power supply terminals 1 and 2 using the switching signals from the control circuit 3.

The cold cathode discharge tube drive circuit as shown in FIG. 1 is configured by using three inverter transformers T1 to T3 and three balance transformers CT1 to CT3. As shown in the figure, three primary coils CT1-1 to CT3-1 provided in the three balance transformers CT1 to CT3 are connected in series, and the pulse drive signals from the switching circuit 4 are applied to both ends of the series connection.

Further, a secondary coil CT1-2 provided in the balance transformer CT1 and the primary coil T1-1 provided in the inverter transformer T1 are connected in series, and the pulse drive signals from the switching circuit 4 are applied to both ends of the series connection. In addition, the secondary coil CT2-2 provided in the balance transformer CT2 and the primary coil T2-1 provided in the inverter transformer T2 are connected in series, and the pulse drive signals from the switching circuit 4 are applied to both ends of the series connection. In the same manner, the secondary coil CT3-2 provided in the balance transformer CT3 and the primary coil T3-1 provided in the inverter transformer T3 are connected in series, and the pulse drive signals from the switching circuit 4 are applied to both ends of the series connection.

Further, one of terminals of the secondary coil T1-2 of the inverter transformer T1 is connected to ground by way of a cold cathode discharge tube FL1 and a resister R1, and the other terminal is directly connected to ground. In addition, one of terminals of the secondary coil T2-2 of the inverter transformer T2 is connected to ground by way of a cold cathode discharge tube FL2 and a resister R2, and the other terminal is directly connected to ground. In the same manner, one of terminals of the secondary coil T3-2 of the inverter transformer T3 is connected to ground by way of a cold cathode discharge tube FL3 and a resister R3, and the other terminal is directly connected to ground. Further, a connecting mid-point of the cold cathode discharge tube FL3 and the resister R3 is pulled out, and is fed back to the control circuit 3 as a F/B signal relating to the current flowing through the cold cathode discharge tube FL3.

Ether an oscillation frequency of an oscillation circuit or a pulse width modulation with a PWM circuit included in the control circuit 3 modulates the switching signal by feeding back the F/B signal to the control circuit 3. Thereby, the current flowing through the cold cathode discharge tube FL3 is controlled to be constant, and the emitting brightness of the cold cathode discharge tube FL3 is set to be uniform. In addition, the currents flowing through the three inverter transformers T1 to T3 are controlled to be the same by providing the three balance transformers CT1 to CT3, it is possible to emit all the cold cathode discharge tubes FL1 to FL3 to be uniform.

Each of the inverter transformers T1 to T3 used in the cold cathode discharge tube drive circuit shown in FIG. 1 comprises a single primary coil and a single secondary coil. However, the configuration of the inverter transformer, a connecting relation between the inverter transformer and the cold cathode discharge tubes, a connecting relation to the balance transformer, and the like are not limited to the configuration illustrated in FIG. 1, and various modifications are possible.

Figure 2:
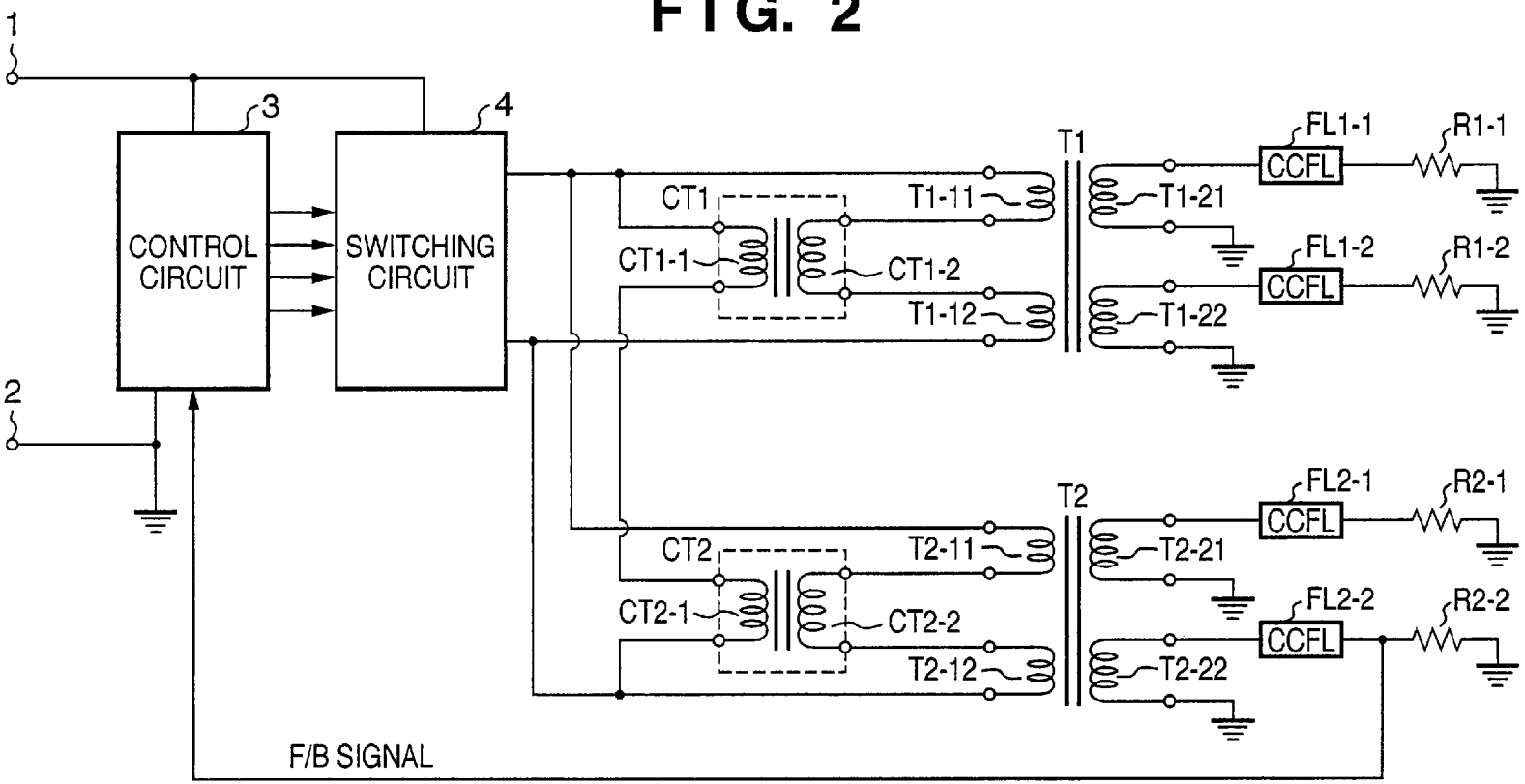
FIG. 2 is a circuit diagram of a cold cathode discharge tube drive circuit according to first embodiment of the present invention to which a transformer apparatus or an inverter transformer according to embodiments of the present invention.

For example, as illustrated in FIG. 2, other example of the cold cathode discharge tube drive circuit according to one embodiment of the present invention to which a transformer apparatus or an inverter transformer according to the embodiment of the present invention is adapted. In FIG. 2, the same reference codes are applied to the portions common to FIG. 1, and the description thereof is omitted.

In the figure, two inverter transformers T1 and T2 each comprising two primary coils and two secondary coils are used as inverter transformers. That is, the inverter transformer T1 comprises two primary coils T1-11 and T2-12, and two secondary coils T1-21 and T1-22. Similarly, the inverter transformer T2 comprises two primary coils T2-11 and T2-12 and two secondary coils T2-21 and T2-22.

The two primary coils T1-11 and T2-12 of the inverter transformer T1 are connected in series to each other while sandwiching the secondary coil CT1-2 of a balance transformer CT1, and the pulse drive signals from the switching circuit 4 are applied to both ends of the serial connection. Similarly, the two coils T2-11 and T2-12 of the inverter transformer T2 are connected in series to each other while sandwiching the secondary coil CT2-2 of the balance transformer CT2, and the pulse drive signals from the switching circuit 4 are applied to both ends of the serial connection.

In addition, the primary coil CT1-1 of a balance transformer CT1 is connected in series to the primary coil CT2-1 of the balance transformer CT2, and the pulse drive signals from the switching circuit 4 are applied to both ends of the serial connection.

Further in respective secondary coils T1-21 and T1-22 of the inverter transformer T1, each one of terminals is connected to ground by way of the cold cathode discharge tubes FL1-1 and FL1-2 and resisters R1-1 and R1-2, and each of the other terminals is directly connected to ground. Similarly, in each of the secondary coils T2-21 and T2-22 of the inverter transformer T2, each one of terminals is connected to ground by way of the cold cathode discharge tubes FL2-1 and FL2-2 and resistors R2-1 and R2-2, and each of the other terminals is directly connected to ground.

Further, a connecting mid-point between the cold cathode discharge tube FL2-2 and the resistor R2-2 is derived, and is fed back to the control circuit 3 as a F/B signal for controlling the current flowing through the cold cathode discharge tube FL2-2. Also in the cold cathode discharge tube drive circuit in FIG. 2, it is possible to emit all the cold cathode discharge tubes to be uniform by the work of the F/B signal and the balance transformers CT1 and CT2.

Second Embodiment

Figure 3:
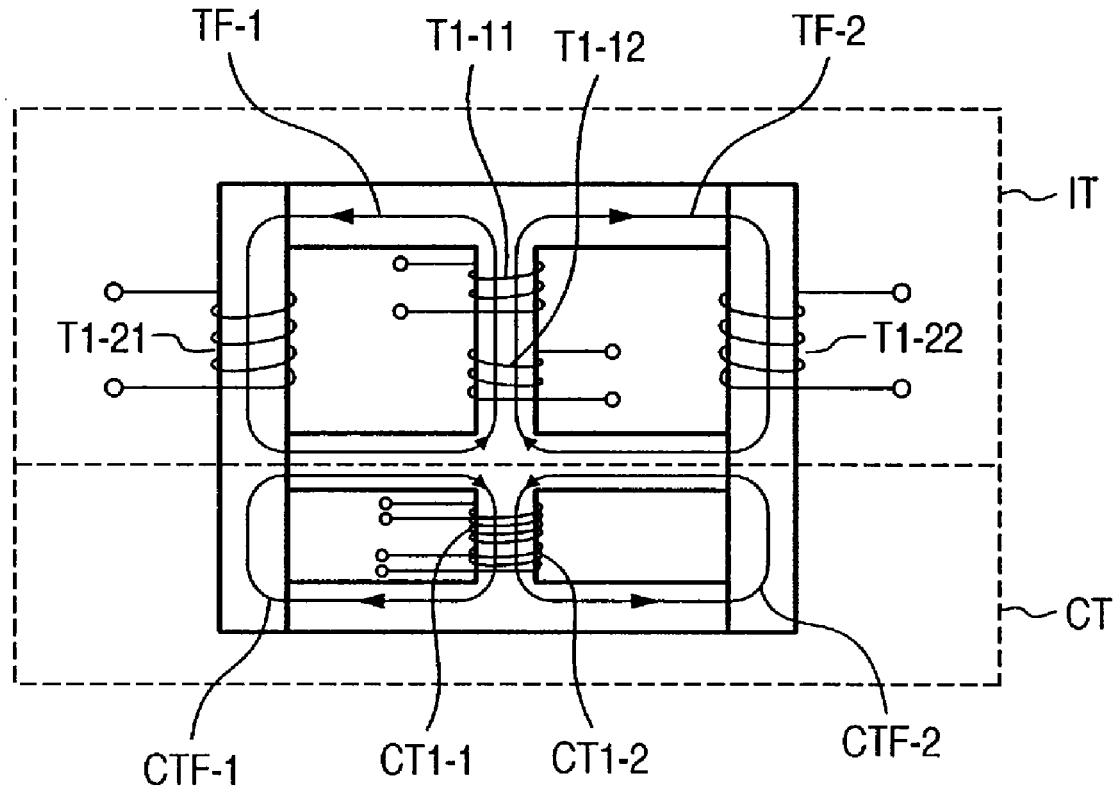
FIG. 3 is a diagram showing a configuration of a transformer apparatus or an inverter transformer according to a second embodiment of the present invention.

FIG. 3 illustrates a transformer apparatus according to a second embodiment of the present invention, wherein the transformer apparatus uses the same type of the inverter transformer used in the cold cathode discharge tube drive circuit in FIG. 2 according to the first embodiment of the cold cathode discharge tube drive circuit. The transformer apparatus illustrated in FIG. 3 has a structure configured by integrally combining the inverter transformer and the balance transformer.

Namely, the transformer apparatus comprises a 王-shaped core portion located at a center and having a shape of Chinese character 王, and two I-shaped core portions provided at both left said and a right side. An axis line of a center core portion of the 王-shaped core portion and an axis line of the two I-shaped core portion are configured to be parallel to each other. As above, the transformer apparatus is configured wherein the core portion is partially shared by the inverter transformer section IT and the balance transformer section CT. In the inverter transformer section IT, two primary coils T1-11 and T2-12 are wound provided at the core portion of the center core portion. Further, each of the secondary coils T1-21 and T1-22 is wound on the I-shaped core portions provided at left and right sides and arranged in parallel to each other.

In the balance transformer section CT, the primary coils CT1-1 and CT1-2 are wound on a core portion of a center core portion. In this case, an axis line of the primary coils CT1-1 and CT1-2 of the balance transformer section CT is provided over an axis line of the primary coil T1-11 and the secondary coil T1-12 of the inverter transformer section IT.

Fluxes generated at the core portions of the inverter transformer section IT are defined as TF-1 and TF-2, and fluxes generated at the core portions of the balance transformer section CT are defined as CTF-1 and CTF-2. In this case, as shown in the figure, in the magnetic path formed with the 王-shaped core portion and the I-shaped core portion, a direction of each coil current and a winding direction of a coil are determined so that the directions of the flux are the same in the core portion extending in parallel at both left and right sides at the center core portion of the 王-shaped core portion where the flux flows commonly.

As described above, it is possible to provide a transformer apparatus that performs a downsizing, a reduction of the number of parts, and a cost saving by partially sharing the core portion and integrally assembling the inverter transformer and the balance transformer. In addition, the primary coils T1-11 and T2-12 are may be connected to a common terminal to which the balance transformer is connected by providing an intermediate tap, and this enables to reduce the number of terminals to be used.

In this case, the configuration of the transformer apparatus in FIG. 3 can be modified into various forms. For example, the transformer apparatus may be configured to be a structure wherein the two primary coils T1-11 and T2-12 provided at the core portion of the center core portion in the 王-shaped core portion may be wound on both ends of the I-shaped core portion together with the secondary coils T1-21 and T1-22 while sharing the core portion. In this case, any coil may not be wound on the core portion at the center core portion of the 王-shaped core portion in the inverter transformer section IT. In addition, also in the balance transformer section CT, it is possible to be a structure wherein the primary coil CT1-1 is wound on one of ends of the I-shaped core portions arranged in parallel to each other, and the secondary coil CT1-2 is wound on the other thereof.

Third Embodiment

Figure 4:
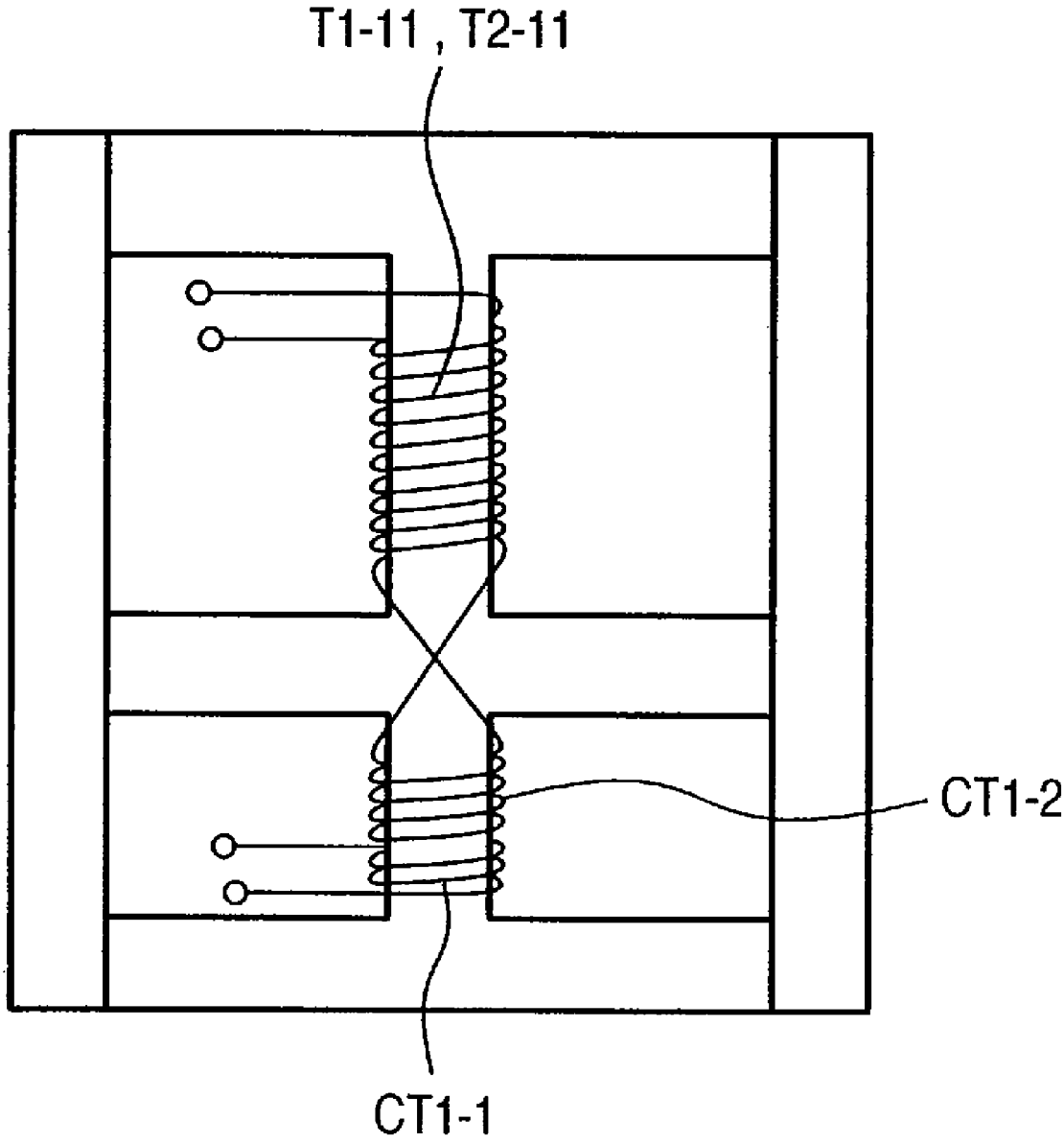
FIG. 4 is a diagram showing a configuration of a transformer apparatus or an inverter transformer according to a second embodiment of the present invention.

FIG. 4 illustrates a transformer apparatus according to the third embodiment of the present invention.

In the cold cathode discharge tube drive circuit in FIG. 2 described as the first embodiment of the present invention, two primary coils T1-11 and T2-12 provided in the inverter transformer T1 are connected in series to each other while sandwiching the secondary coil CT1-2 provided in the balance transformer CT1. Then, the pulse drive signals from the switching circuit 4 are applied to the both ends of the serial connection.

That is, in the transformer apparatus according to the third embodiment in FIG. 4, the other end of the primary coil T1-11 is directly extended and wound as the secondary coil CT1-2 of the balance transformer section CT located at lower side of the 王-shaped core portion. Further, the transformer apparatus has a structure wherein the primary coil is continuously extended and wound directly on the inverter transformer section IT. Further, a primary coil CT1-1 is separately provided at the balance transformer section CT. In this case, two primary coils T1-11 and T2-12 of the inverter transformer section IT and two primary coils CT1-1 and CT1-2 of the balance transformer section CT primary coils CT1-1 and CT1-2 share the center core portion of the E-shaped core portion, and is provided over the same axis line.

With the above described coil configuration, it is possible to reduce the number of lead lines and the number of lead terminals of the transformer apparatus which is configured to include the inverter transformer section IT and the balance transformer section CT. The reduction of the number of terminals enables further downsizing. In this case, the secondary coil is neglected in the inverter transformer section It of the transformer apparatus in FIG. 4.

Fourth Embodiment

Figure 5:
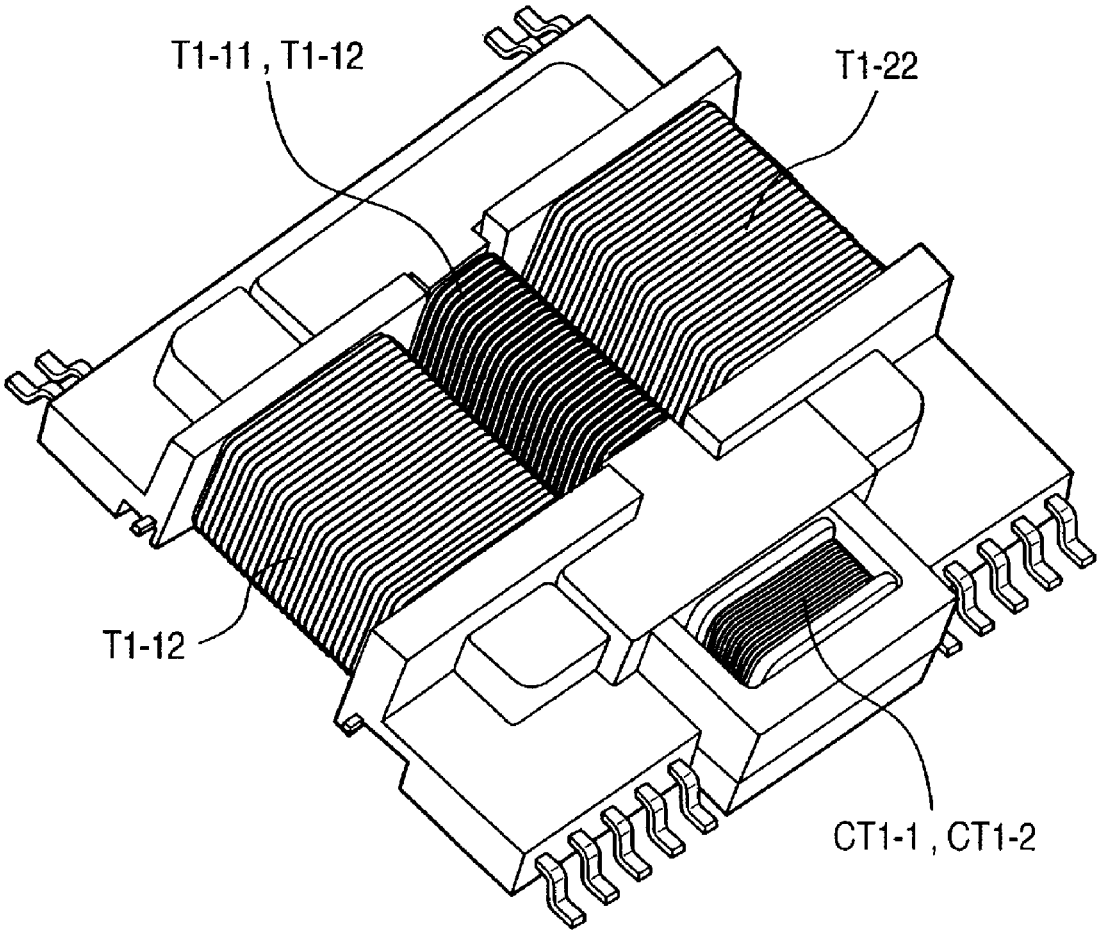
FIG. 5 is an external perspective view of inverter transformer according to a fourth embodiment of the present invention.

FIG. 5 illustrates an external perspective view of a fourth embodiment of the present invention. A transformer apparatus according to the fourth embodiment in FIG. 5, a H-shaped core portion and two I-shaped core portions are used in an inverter transformer section IT, and an E-shaped core portion is used in a balance transformer section CT. The center core portion of the H-shaped core portion and the axis line of the two I-shaped core portions are set to be parallel to each other. The primary coils T1-11 and T2-12 of the inverter transformer section IT are wound on a core portion of a center core portion of the H-shaped core portion. In addition, the primary coils CT1-1 and CT1-2 of the balance transformer section CT are configured to be wound on the core portion of the center core portion of the E-shaped core portion. In FIG. 5, a terminal group for each coil is provided on each support table for supporting each core portion.

As described above, it is possible to provide a small transformer apparatus by configuring to share a part of the core portion.

Other Embodiment

In the transformer apparatus according to the present invention, various modifications are possible in a combined structure of core portions configuring an inverter transformer section IT and a balance transformer section CT. FIGS. 6A to 6F show these modified embodiments, and each embodiment is possible to e an embodiment of the present invention. The transformer apparatus in FIGS. 6A to 6F are illustrated without coils.

Figure 6A:
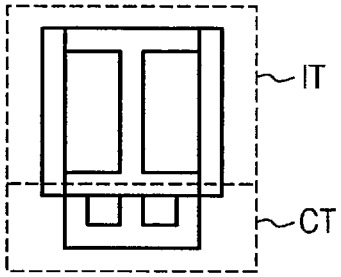
FIGS. 6A to 6F are diagrams showing the other configurations of transformer apparatuses or inverter transformers according to the other embodiments of the present invention.

The embodiment in FIG. 6A corresponds to the fourth embodiment shown in FIG. 5, and has the same configuration with regard to the core portions as those in FIG. 5.

Figure 6B:
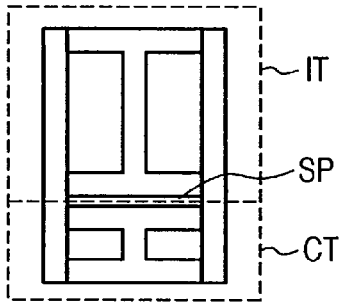

FIG. 6B illustrates a transformer apparatus having a structure comprising H-shaped core portions provided in each of the inverter transformer section IT and the balance transformer section CT, and two I-shaped core portions shared and used by the inverter transformer section It and the balance transformer section CT. In the figure, an insulator SP or an air gap may be provided at an abutting portion at each H-shaped core portion between the inverter transformer section IT and the balance transformer section CT.

Figure 6C:
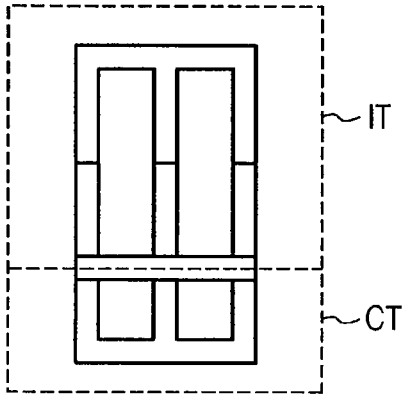

FIG. 6C illustrates a transformer apparatus wherein an inverter transformer section IT uses two E-shaped core portions and a balance transformer section CT uses one E-shaped core portion. In this case, the number of the core portions is three, and each center core portion of the E-shaped core portions are provided on the same axis line.

Figure 6D:
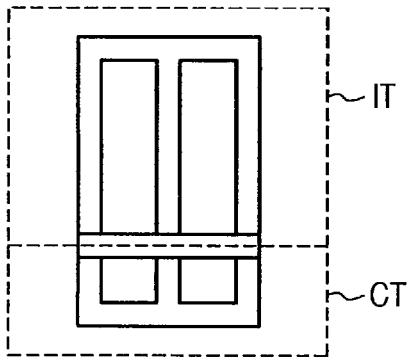

FIG. 6D illustrates a transformer apparatus wherein each of an inverter transformer section IT and a balance transformer section CT uses an E-shaped core portion and uses to share one I-shaped core portion. The number of the core portions is also three.

Figure 6E:
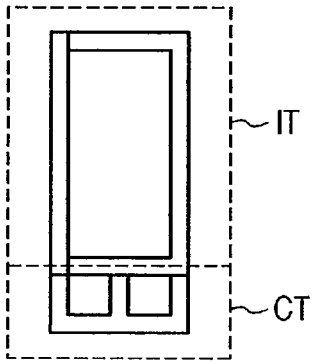

In FIG. 6E, a transformer apparatus is illustrated wherein the inverter transformer section IT uses an I-shaped core portion and an U-shaped core portion, and a balance transformer section CT uses one E-shaped core portion. The number of the core portions is also three.

Figure 6F:
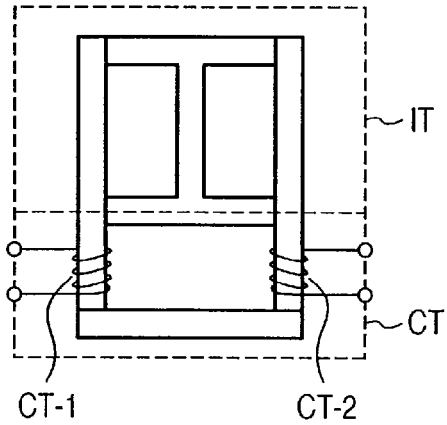

Further, FIG. 6F illustrates another modified embodiment wherein the transformer apparatus comprises an inverter transformer section IT using an H-shaped core portion, a balance transformer section CT uses a single I-shaped core portion, and commonly used two I-shaped core portions. In this embodiment, the coils CT-1 and CT-2 of the balance transformer section CT are wound on each of the I-shaped core portions.

As described above, it becomes possible to attain a downsizing, a reduction of the number of parts, and a reduction of production steps by integrally forming the inverter transformer section IT and the balance transformer section CT and by sharing and using a part of core portion of each transformer as a magnetic path.

Further, in the transformer structure in which a primary coil is wound on the H-shaped core portion as shown in FIG. 5, and secondary coils are wound on each I-shaped core portion provided on both ends of the H-shaped core portion, the magnetic coupling rate tends to be deteriorated. For example, with the structure configured as above described, an air gap may exist at a joint surface between the I-shaped core portion and the H-shaped core portion. Accordingly, a part of the flux generated from the primary coil may leak to outside before reaching the secondary coil, so that the magnetic coupling may be deteriorated. Resultantly, not only the transformer shown in FIG. 5, a magnetic coupling rate has been deteriorated in a transformer having a configuration including an air gap at a joint surface between cores.

Figure 7:
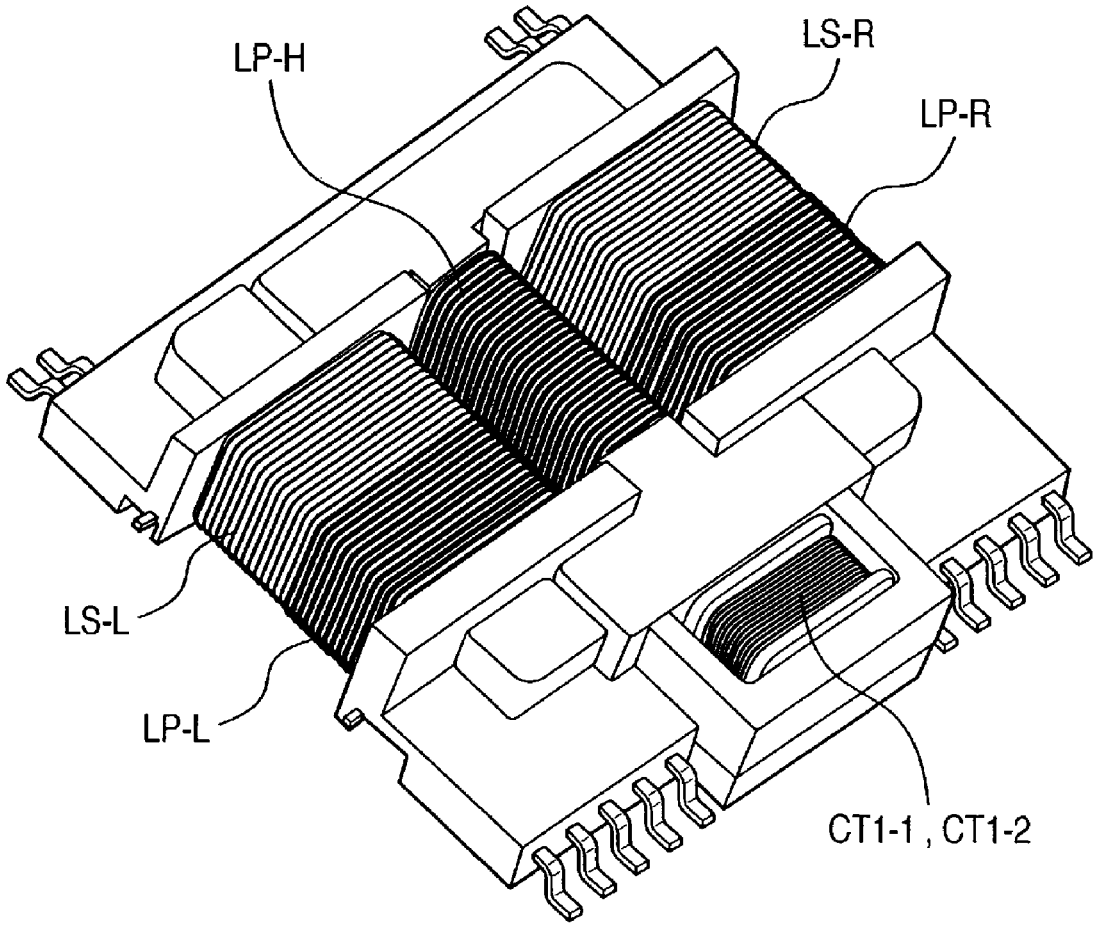
FIG. 7 is an external perspective view of a transformer apparatus or an inverter transformer according to further another embodiment of the present invention.

As shown in FIG. 7, it is possible, as a better embodiment for avoiding the above-mentioned defects, to increase a coupling coefficient k as a representative of a magnetic coupling rate by winding a part of the primary coil to be wound on the H-shaped core portion on a coil bobbin of the secondary coil. In FIG. 7, it is possible to vary a relation between the magnetic coupling rate and the leakage inductance value by increasing or decreasing the number of turns of the primary coil to be wound on the secondary coil.

Namely in FIG. 7, a coil LP-H is a primary coil wound on the center core portion of the H-shaped core portion, a coil LP-R is a primary coil wound on a secondary coil LS-L located in a left side, and a coil LP-R is a primary coil wound on a secondary coil LS-R located in a right side. These primary coils LP-L, LP-H and LP-R are connected in series.

FIG. 8 is a test data table that shows that a coupling coefficient k can be changed depending on the number T of turns of the primary coils LP-L and LP-R wound on the secondary coils LS-L and LS-R in the configuration in FIG. 7. In the test data table in FIG. 8, an Lp denotes an inductance value generated by the primary coils LP-L, LP-H and LP-R, a Ls denotes an inductance value generated by one of the secondary coil LS-L or LS-R, and an Ls' denotes a leakage inductance value. In this case, a relation between the inductance values and the coupling coefficient k is expressed as $k^2=1-(Ls'/Ls)$.

As will be seen from the table in FIG. 8, the coupling coefficient k increases as the number of turns of the primary coils LP-L and LP-R wound on the secondary coils LS-L and LS-R increases.

In each transformer apparatus according to each embodiment of the present invention, coils may be wound on any core portion in the inverter transformer section IT and the balance transformer section CT unless departing from its role in each embodiment. Further, separate plates are provided on the bobbin for winding the secondary coil according to each embodiment of the present invention, and each embodiment is so designed that a voltage difference between a winding start position and a winding end position of the coil wound on a coil groove within the separate plates becomes about 300V.

Even if a winding start lead and a winding end lead are contacted by breaking up of coils during windings of coils, it is so configured as to fully maintain a withstand voltage by an insulator film of the coil wire. Further, materials for the bobbin to be used are formed with thermoplastics, so that any burr does not appear, and it is possible to avoid breaking up of coils even a wire having a small diameter is employed.

Further, it is possible to directly wind the primary coil, if an NI—Zn system core portion is used as the H-shaped core portion provided between two I-shaped core portions. An Ni—Zn system core portion shows extremely higher insulation resistance than Mn—Zn system core portion, so that it is not necessary to maintain insulation using coil bobbins. Further in the inverter transformer, a large current flows through the primary coil than the secondary coil, so that a wire having a fairly larger diameter is used for the primary coil than the secondary coil. Accordingly, even if the primary coil directly wound on the core portion, breaking of coil seldom occurs.

Further, it is possible to make it easy to wind coils by providing a step at an end of a coil axis of the H-shaped core portion. It is assumed that the inverter transformer section IT is configured with an H-shaped core portion and two I-shaped core portions and the balance transformer section CT is formed at an end portion of the H-shaped core portion wit an E-shaped core portion and a coil bobbin. In this case, in the balance transformer section CT and the inverter transformer section IT, the flux flows through a common flux path at portion where the H-shaped core portion and the E-shaped core portion contact to each other. However, the flux tends to flow a shorter flux path, so that the flux generated by the inverter transformer section IT seldom comes into the flux path generated by the balance transformer section CT, and they do not interfere.

The above is described as a transformer apparatus having an integrated inverter transformer section It and a balance transformer section CT. However, the present invention can be defined as an inverter transformer having an integrated balance transformer section CT.

According to the present invention, it is possible to provide a downsized transformer apparatus by integrating an inverter transformer and a balance transformer. Thereby, it is possible to save space on a whole circuit board, and the balance transformer is built in the transformer apparatus, so that it also possible to yield cost merits. Further, a balance transformer is provided at a low voltage side, namely at a primary coil side of the drive transformer, so that it is not necessary to provide parts for adjusting currents at a high voltage side. This solves insulation problems.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-116159, filed Apr. 19, 2006 and 2007-018469, filed Jan. 29, 2007 which are hereby incorporated by reference herein in their entirety.

What is claimed is:

1. A transformer apparatus comprising: an inverter transformer having a primary coil and a secondary coil; the inverter transformer operative to generate a first magnetic flux;

a balance transformer having a primary coil and a secondary coil; the balance transformer operative to generate a second magnetic flux;

wherein the inverter transformer and balance transformer are integrally formed by sharing a part of a core portion of the transformer apparatus such that directions of the first and second magnetic fluxes are the same in the part of the core portion;

wherein the primary coil of the inverter transformer is wound on a center core portion of an H-shaped core portion of the inverter transformer;

wherein the secondary coil of the inverter transformer is wound on a core portion of an I-shaped core portion of the inverter transformer; and wherein the primary coil and the secondary coil of the balance transformer are wound on a center core portion of an E-shaped core portion of the balance transformer.

2. The transformer apparatus according to claim 1 wherein:

the secondary coil of the inverter transformer is provided so that an axis line of the secondary coil becomes parallel to an axis line of the primary coil in the inverter transformer; and the balance transformer is provided on the axis line of the primary coil of the inverter transformer.

3. The transformer apparatus according to claim 1 wherein a portion of the primary coil of the balance transformer is wound on the axis line of the secondary coil of the inverter transformer.

4. An inverter transformer assembly for driving discharge tubes comprising:

an inverter transformer having a primary coil and a secondary coil operative to generate a first magnetic flux; wherein an axis line of the primary coil of the inverter transformer and an axis line of the secondary coil of the inverter transformer are parallel to each other;

coils configuring a balance transformer having a primary coil and a secondary coil that are operative to generate a second magnetic flux;

wherein the primary coil and the secondary coil of the balance transformer are mounted on the axis line of the primary coil of the inverter transformer; and wherein a direction of the first magnetic flux is opposite to a direction of the second magnetic flux on the axis line of the primary coil of the inverter transformer;

wherein the primary coil of the inverter transformer is wound on a center core portion of an H-shaped core portion of the inverter transformer;

wherein the secondary coil of the inverter transformer is wound on a core portion of an I-shaped core portion of the inverter transformer; and wherein the primary coil and the secondary coil of the balance transformer are wound on a center core portion of an E-shaped core portion of the balance transformer.

5. The inverter transformer assembly according to claim 4 wherein a part of the primary coil of the balance transformer is wound on the axis line of the secondary coil of the inverter transformer.

6. An inverter transformer for driving discharge tubes comprising:

a primary coil;

a secondary coil; wherein an axis line of the primary coil and an axis line of the secondary coil are parallel to each other;

a coil provided on the axis line of the primary coil that functions as a balance transformer;

wherein the primary coil and the secondary coil are wound so that magnetic fluxes generated by both the primary coil and the secondary coil are configured to couple to each other;

wherein a direction of flux path for a magnetic flux generated by the coil for the balance transformer is opposite on the axis line of the primary coil to a direction of the magnetic fluxes generated by the both the primary coil and the secondary coil; wherein the primary coil of the inverter transformer is wound on a center core portion of an H-shaped core portion of the inverter transformer;

wherein the secondary coil of the inverter transformer is wound on a core portion of an I-shaped core portion of the inverter transformer; and wherein the primary coil and the secondary coil of the balance transformer are wound on a center core portion of an E-shaped core portion of the balance transformer.

7. The inverter transformer according to claim 4 wherein a part of the primary coil is wound on the axis line of the secondary coil.

* * * * *